US005151405A

United States Patent [19]

Janssens et al.

[11] Patent Number: 5,151,405

[45] Date of Patent: Sep. 29, 1992

[54] MODIFIED DEXTRAN BINDER FOR USE IN THERMAL DYE TRANSFER

[75] Inventors: Wilhelmus Janssens, Langdorp; Herman J. Uytterhoeven, Bonheiden; Joan T. Vermeersch, Deinze; Jan A. Van der Bogaert, Schilde, all of Belgium

[73] Assignee: Agfa-Gevaert, N.V., Mortsel, Belgium

[21] Appl. No.: 658,584

[22] Filed: Feb. 21, 1991

[30] Foreign Application Priority Data

Mar. 1, 1990 [EP] European Pat. Off. ..... 90200481.1

[51] Int. Cl.[5] ..... B41M 5/035; B41M 5/26

[52] U.S. Cl. ..... 503/227; 428/195; 428/480; 428/532; 428/913; 428/914

[58] Field of Search ..... 8/471; 428/195, 480, 428/532, 913, 914

[56] References Cited

U.S. PATENT DOCUMENTS 4,772,582 9/1988 De Boer ..... 503/227

*Primary Examiner*—B. Hamilton Hess
*Attorney, Agent, or Firm*—Breiner & Breiner

[57] ABSTRACT

Dye-donor element for use in thermal dye sublimation transfer methods, said element comprising a support having thereon a dye/binder layer comprising a dye carried by at least one modified dextran binder.

11 Claims, No Drawings

MODIFIED DEXTRAN BINDER FOR USE IN THERMAL DYE TRANSFER

BACKGROUND OF THE INVENTION

1. Field of the Invention

The present invention relates to dye-donor elements for use in thermal dye sublimation transfer methods, the dye-donor elements comprising a dye/binder layer incorporating a high-molecular dextran derivative binder,which facilitates printing of said dye/binder layer by printing techniques such as a gravure process.

2. Description of the Prior Art

Thermal transfer methods have been developed to make prints from electronic pattern information signals e.g. from pictures that have been generated electronically by means of a colour video camera. To make such prints the electronic picture can be subjected to colour separation with the aid of colour filters. The different colour selections thus obtained can then be converted into electric signals, which can be processed to form cyan, magenta, and yellow electrical signals. The resulting electrical colour signals can then be transmitted to a thermal printer. To make the print a dye-donor element having repeated separate areas of cyan, magenta, and yellow dye is placed in face-to-face contact with a receiving sheet and the resulting sandwich is inserted between a thermal printing head and a platen roller. The thermal printing head, which is provided with a plurality of juxtaposed heat-generating resistors, can selectively supply heat to the back of the dye-donor element. For that purpose it is heated up sequentially in correspondence with the cyan, magenta, and yellow electrical signals, so that dye from the selectively heated regions of the dye-donor element is transferred to the receiver sheet and forms a pattern thereon, the shape and density of which are in accordance with the pattern and intensity of the heat supplied to the dye-donor element.

The dye-donor element usually comprises a very thin support e.g. a polyester support, which is coated on both sides with an adhesive or subbing layer, one adhesive or subbing layer being covered with a slipping layer that provides a lubricated surface against which the thermal printing head can pass without suffering abrasion, the other adhesive layer at the opposite side of the support being covered with a dye/binder layer, which contains the printing dyes in a form that can be released in varying amounts depending on, as mentioned above, how much heat is applied to the dye-donor element.

The dye in the dye/binder layer is usually carried by a binder resin. Known binder resins are cellulose derivatives like ethyl cellulose, hydroxyethyl cellulose, ethylhydroxy cellulose, ethylhydroxyethyl cellulose, hydroxypropyl cellulose, methyl cellulose, cellulose acetate, cellulose acetate formate, cellulose acetate propionate, cellulose acetate butyrate, cellulose acetate pentanoate, cellulose acetate hexanoate, cellulose acetate heptanoate, cellulose acetate benzoate, cellulose acetate hydrogen phthalate, and cellulose triacetate; vinyl-type resins like polyvinyl alcohol, polyvinyl acetate, polyvinyl butyral, polyvinyl pyrrolidone, polyvinyl acetoacetal, and polyacrylamide; polymers and copolymers derived from acrylates and acrylate derivatives, such as polyacrylic acid, polymethyl methacrylate, and styrene-acrylate copolymers; polyester resins; polycarbonates; poly(styrene-co-acrylonitrile); polysulfones; polyphenylene oxide; organosilicones such as polysiloxanes; epoxy resins and natural resins, such as gum arabic.

The dye/binder layer comprising said repeated separate areas of cyan, magenta, and yellow dye carried by a binder may be coated from a solution in appropriate solvents on the subbed support, but the known coating techniques are not quite adapted to the discontinuous repeated coating of three differently coloured dye/-binder areas on said very thin support. It is therefore customary, especially in large-scale manufacturing conditions, to print said dye/binder layer on said support by printing techniques such as a gravure process.

However, most binders have one or more disadvantages. For instance, some binders have a low viscosity and thus form a dye/binder composition that does not have an ink-like nature and as a consequence is not printable. Other binders have a suitable viscosity, but are soluble only in solvents such as chlorinated hydrocarbon solvents, which are rejected nowadays from an ecological standpoint. Other binders cause dye crystallization, which is to be avoided since it prevents effective thermal dye transfer and consequently produces low and erratic print densities on the receiver sheet.

Another frequently encountered disadvantage of binders is that when heat is supplied by the thermal printing head to the dye-donor element, the dye/binder layer melts and consequently starts sticking to the receiver sheet. This sticking eventually results in the tearing off of the dye/binder layer.

SUMMARY OF THE INVENTION

It is therefore an object of the present invention to provide a dye-donor element for use in thermal dye sublimation transfer methods, said element comprising in the dye/binder layer a binder that facilitates printing of the dye/binder composition and makes possible an easy and effective thermal dye transfer that yields dye images with a high density.

This and other objects are achieved by providing a dye-donor element for use in thermal dye sublimation transfer methods, said element comprising a support having thereon a dye/binder layer comprising a dye carried by at least one dextran binder, wherein at least some of the hydroxy groups of said binder have been modified into one or more groups chosen from the class consisting of ether, carboxylic ester, carbonate, carbamoyloxy, hemiacetal, and acetal.

It has been established that in comparison with natural dextrans, which are poly-(Alpha-1,6-D-glucopyranosides that are soluble in water, the above modified high-molecular dextran binders are relatively hydrophobic, insoluble in water, but soluble in ecologically acceptable organic solvents such as i.a. methanol, 3-methoxypropanol, ethyl methyl ketone, ethyl acetate, acetone toluene, xylene, formamide, dimethylformamide, tetrahydrofuran, and dioxan and that a solution of said binder and sublimable dye has an ink-like nature and can easily be printed by gravure on a support.

DETAILED DESCRIPTION OF THE INVENTION

The dye-donor element according to the present invention comprises a support, which preferably is coated on both sides with an adhesive layer, one adhesive layer being covered with a slipping layer to prevent the thermal printing head from sticking to the dye-donor element, the other adhesive layer at the opposite side of the support being covered, preferably by printing according to a gravure printing technique, with a dye/binder layer, which contains the printing dyes in a form that can be released in varying amounts depending on, as mentioned above, how much heat is applied to the dye-donor element, said printing dyes being carried by a polymeric binder medium comprising a dextran binder, which has been modified by reaction of hydroxy groups thereof with one or more of the following reagents:

- haloformates e.g. ethyl chloroformate, 2-chloroethyl chloroformate, phenyl chloroformate, 4-nitrophenyl chloroformate, 3-methoxyphenyl chloroformate, and 4-chlorophenyl chloroformate,
- acid halides e.g. acetyl chloride, butyryl bromide, benzoyl fluoride, and acryloyl chloride,
- carboxylic acids e.g. acetic acid, propionic acid, and butyric acid,
- alkylating agents e.g. dimethyl sulphate, diethyl sulphate, methyl iodide, ethyl iodide, diethylaminoethyl chloride, benzyl chloride, ethyl chloroacetate, chloroacetic acid, and chloromethyl phosphonic acid,
- epoxides e.g. propylene oxide. epichlorohydrin, ethylene oxide, and butylene oxide,
- aldehydes e.g. butyraldehyde,
- chlorosulphonic acid esters, chlorosulphonic acid, and (poly)phosphoric acid.

According to a preferred embodiment of the present invention a dextran binder is used, wherein at least some of its hydroxy groups have been modified into one or more of the following groups:

$$-O-R^1$$

$$-O-CO-R^2$$

wherein:

- $R_1$ represents an alkyl group e.g. methyl and ethyl, a substituted alkyl group, a cycloalkyl group, a substituted cycloalkyl group, an alkenyl group, an aryl group e.g. phenyl, or a substituted aryl group,
- $R_2$ has one of the significances given for $R_1$ or stands for one of the following groups $-OR^3$ and $-N(R_4)R_5$, wherein $R_3$ has one of the significances given for $R_1$ and each of $R_4$ and $R_5$ (same or different) represent hydrogen or an organic group such as an alkyl group, a substituted alkyl group, an aryl group, or a substituted aryl group.

In addition to modifying at least some of the hydroxy groups of said dextran binder into one or more groups chosen from the class consisting of ether, carboxylic ester, carbonate, carbamoyloxy, hemiacetal, and acetal groups,it is also possible, in case only part of the hydroxy groups have been modified into one or more groups chosen from the class consisting of ether, carboxylic ester, carbonate carbamoyloxy, hemiacetal, and acetal groups, to supplementarily modify at least part of the remaining hydroxy groups into groups that are more hydrophilic or more polar than said ether, carboxylic ester, carbonate, carbamoyloxy, hemiacetal, and acetal groups. Such more hydrophilic or more polar groups are e.g. nitrate, sulphate, sulphonate, phosphate, and carboxylate groups. The introduction of the latter groups may offer the advantage that improved layer properties, an improved printing quality, an improved adhesion of the dye/binder layer to the support, and a higher viscosity of the ink-like dye/binder combination are obtained.

It has also been established that thanks to the above-described supplemental introduction of more hydrophilic or more polar groups the resulting modified dextran binders can be used advantageously also as a binder for the dye-image-receiving layer of the receiving sheet.

The present invention therefore also provides a method of image-wise heating a dye-donor element comprising a support and a dye layer comprising printing dyes carried by a polymeric binder medium, which can be or can comprise a dextran binder, at least some of the hydroxy groups of which have been modified into ether, carboxylic ester, carbonate, carbamoyloxy, hemacetal, or acetal groups and, in case only part of the hydroxy groups of said dextran binder have been modified in such groups, at least part of the remaining hydroxy groups may supplementarily have been modified into groups that are more hydrophilic or more polar than said ether, carboxylic ester, carbonate, carbamoyloxy, hemiacetal, and acetal groups and transferring said image-wise heated printing dyes to a dye-image-receiving layer of a receiving sheet, wherein said dye-image-receiving layer comprises a dextran binder, part of the hydroxy groups of which have been modified into ether, carboxylic ester, carbonate, carbamoyloxy, hemiacetal, or acetal groups and the other part of the hydroxy groups have been modified into groups that are more hydrophilic or more polar than said ether, carboxylic ester, carbonate, carbamoyloxy, hemiacetal, or acetal groups.

For easiness'sake the expression "supplementarily modified dextran binders" will be used hereinafter for dextran binders into which ether, carboxylic ester, carbonate, carbamoyloxy, hemiacetal, or acetal groups have been introduced and into which which additionally such more hydrophilic or more polar groups groups like e.g. nitrate, sulphate, sulphonate, phosphate, or carboxylate groups have been introduced.

Examples of modified high-molecular dextran binders for use in accordance with the present invention are listed in the following Table 1:

TABLE 1

D01 which is a dextran phenyl carbonate corresponding to the structural formula, wherein x = 6 mol % and y = 94 mol % molecular weight: 70,000

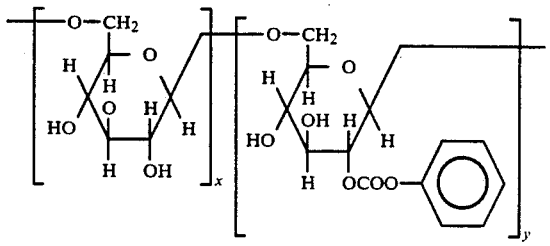

D02 which is a dextran ethyl carbonate corresponding to the structural formula, wherein x = 60 mol % and y = 40 mol %: molecular weight: 70,000

TABLE 1-continued

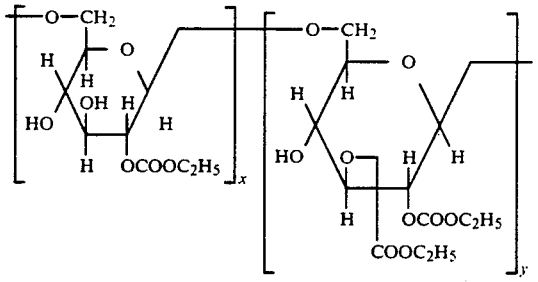

D03 which is a dextran tributyrate corresponding to the following formula: molecular weight: 70,000

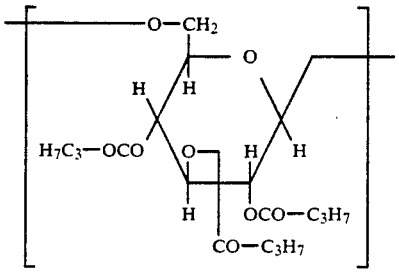

D04 which is a dextran tripropionate corresponding to the following structural formula: molecular weight: 70,000

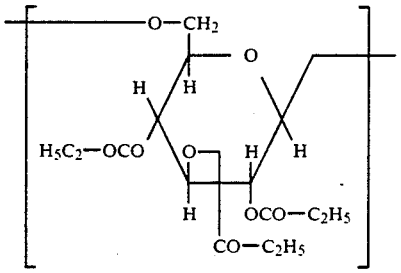

D05 which is a dextran tributyrate corresponding to the structural formula of D03, molecular weight: 150,000

D06 which is a dextran tripropionate corresponding to the structural formula of D04, molecular weight: 500,000

D07 which is a dextran tripropionate corresponding to the structural formula of D04, molecular weight: 150,000

D08 which is a dextran tripropionate corresponding to the structural formula of D04, molecular weight: 2,000,000

D09 which is a dextran benzyl ether corresponding to the following structural formula wherein R stands for benzyl: molecular weight: 70,000

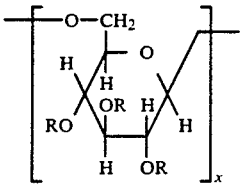

D10 which is a dextran triacetate corresponding to the following structural formula: molecular weight: 70,000

TABLE 1-continued

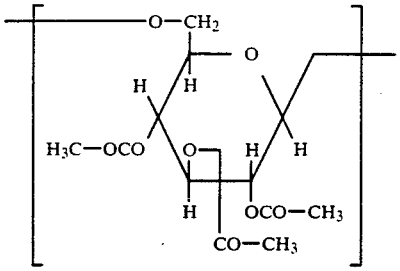

D11 which is a dextran triheptanoate corresponding to the following structural formula: molecular weight: 70,000

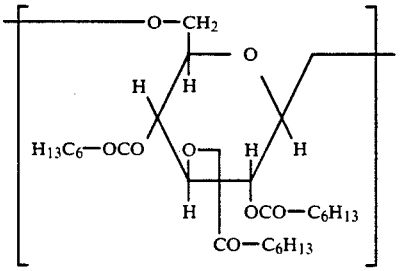

D12 which is a dextran butyl carbamate corresponding to the following structural formula: molecular weight: 70,000

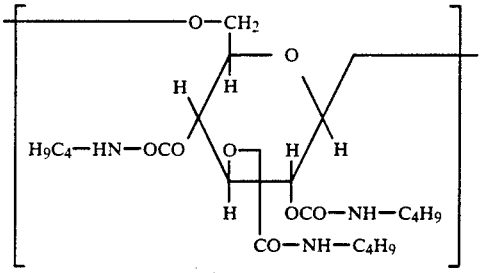

The synthesis of reaction products of dextran and alkyl or aryl haloformates viz. the synthesis of dextran ethyl carbonate and of dextran phenyl carbonate has been described in U.S. Pat. No. 4,879,209.

The preparation of other modified dextrans according to the present invention is illustrated by the following preparation examples.

Preparation of the Dextran Tripropionate D04

An amount of 10 g (0.062 mol) of dextran having an average molecular weight of 70.000 is dissolved in 100 ml of formamide and 100 ml of dry methylene chloride is added to the solution. An azeotropic mixture of methylene chloride and any water, if present, is distilled off. A volume of 100 ml of dry pyridine is added and 0.76 g (0.062 mol) of 4-dimethylaminopyridine is added as a catalyst. Next, 36 ml of propionic anhydride is added dropwise. The reaction mixture is stirred for 48 h at room temperature. The subnatant viscous layer is separated and diluted with 200 ml of methanol. The triester is precipitated by addition of 2 l of water.

A dextran tributyrate such as the above identified D03 is prepared analogously as described for D04, but by using butyric anhydride instead of propionic anhydride.

Preparation of the dextran benzyl ether D09

An amount of 100 g of dextran having an average molecular weight of 70,000 is dissolved in 5 l of dry dimethyl sulphoxide under nitrogen atmosphere. The solution obtained is mixed slowly with 5 l of a very dry solution of 10% by weight of sodium hydride in dimethyl sulphoxide. An amount of 450 ml of benzyl chloride is added to the resulting mixture. The reaction is allowed to continue overnight with stirring. The reaction product is precipitated with water and dried.

Preparation of the Dextran Triacetate D10

An amount of 10 g (0.062 mol) of dextran having an average molecular weight of 70,000 is dissolved in 100 ml of formamide. To the resulting solution 100 ml of dry pyridine and 0.76 g (0.062 mol) of 4-dimethylaminopyridine is added. A slight excess (1.5 equivalent) of acetic anhydride is added dropwise to the reaction mixture. After a reaction time of 20 h at room temperature the reaction mixture has turned into a gel. The gel is added to water. The gel particles shrink and a light-coloured filterable precipitate is formed.

Preparation of the Dextran Triheptanoate D11

An amount of 10 g (0.062 mol) of dextran having an average molecular weight of 70.000 is dissolved in 100 ml of formamide. To the resulting solution 100 ml of dry methylene chloride is added. An azeotropic mixture of methylene chloride and any water, if present, is distilled off. A volume of 100 ml of dry pyridine is added and 0.76 g (0.062 mol) of 4-dimethylamnopyridine is added as a catalyst. Next, 73 ml of heptanoic anhydride is added dropwise. The reaction mixture is stirred for 48 h at room temperature. The subnatant viscous layer is separated and dissolved in 250 ml of diethyl ether. The triester is precipitated in methanol.

Preparation of the Dextran Butyl carbamate D12

An amount of 100 g of dextran having an average molecular weight of 70,000 is dissolved in 3 l of dry dimethyl sulphoxide at 70° C. in a heated reactor entirely isolated to avoid contact with humidity. An amount of 183 g of butyl isocyanate is added slowly under nitrogen atmosphere. The reaction is allowed to continue until all of the butyl isocyanate has entered into reaction. The reaction product is precipitated with acetone, then dissolved in methanol, reprecipitated with acetone, and dried.

As mentioned hereinbefore, it is also possible to use an above-mentioned supplementarily modified dextran binder. An example of such supplementarily modified dextran is:

SO1 which is a dextran (molecular weight:500,000) derivative, in which 80% of the hydroxy groups have been modified with propionic acid and the remaining 20% with succinic acid.

SO2 which is a dextran (molecular weight:500.000) derivative, in which 80% of the hydroxy groups have been modified with propionic acid and the remaining 20% with phthalic acid.

SO3 which is a dextran (molecular weight:500,000) derivative, in which 80% of the hydroxy groups have been modified with propionic acid and the remaining 20% with benzoic acid.

The synthesis of such supplementarily modified dextran is illustrated by the following preparation examples of SO1 and SO3.

Preparation of the Dextran SO1

An amount of 10 g of dextran (molecular weight : 500,000) is dissolved in 130 ml of formamide and 100 ml of methylene chloride is added to the solution. An azeotropic mixture of methylene chloride and water is distilled off. An amount of 0.76 g of dimethylaminopyridine and 19 g of propionic anhydride is added. The reaction mixture is stirred for 70 h. An amount of 1.2 g (0.01 mol) of succinic anhydride is added at 40° C. The reaction product is precipitated in water dried, and dissolved in ethyl methyl ketone. The resulting solution is treated with a 0.01 N hydrochloric acid. The ethyl methyl ketone phase is separated and dried over magnesium sulphate. The product is concentrated by evaporation.

Preparation of the Dextran SO3

An amount of 5 g of dextran (molecular weight : 500,000) is dissolved in 65 ml of formamide and 50 ml of methylene chloride is added to the solution. An azeotropic mixture of methylene chloride and water is distilled off. A volume of 50 ml of pyridine and 0.4 g of dimethylaminopyridine is added. Next, 4.2 g (0.0186 mol) of benzoic anhydride is added. The reaction mixture is stirred for 48 h. A volume of 20 ml of propionic anhydride and 0.4 g of dimethylaminopyridine is added. Stirring is continued for 24 h. The reaction product is precipitated in water, filtered, and dried.

The dye/binder layer is formed preferably by dissolving the dyes, the polymeric binder medium, and other optional components in a suitable solvent or solvent mixture to form an ink-like composition that is applied to a support and dried. The support may have been provided first with an adhesive layer.

The polymeric binder medium comprising the modified high-molecular dextran of the present invention can be added to the dye/binder layer in widely varying concentrations In general, good results are obtained when the dye/binder layer comprises 0.1 to 5 g of polymeric binder medium per m2.

Any dye can be used in the dye/binder layer of the dye-donor element of the present invention provided it is easily transferable to the receiver sheet by the action of heat and has a satisfactory fastness to light. Suitable dyes are those described in e.g. EP-A 209,990, EP-A 209,991. EP-A 216,483, EP-A 218,397, EP-A 227,095, EP-A 227,096, EP-A 229,374, EP-A 257,577, EP-A 257,580, JP 84/78894 JP 84/78895, JP 84/78896, JP 84/227,490, JP 84/227,948, JP 85/27594, JP 85/30391, JP 85/229,787, JP 85/229,789, JP 85/229,790, JP 85/229,791, JP 85/229,792, JP 85/229,793, JP 85/229,795, JP 86/41596, JP 86/268,493, JP 86/268,494, JP 86/268,495, and JP 86/284,489. Particularly good results have been obtained with sublimable dyes such as those described in the following Table 2.

TABLE 2
Cyan dye C01
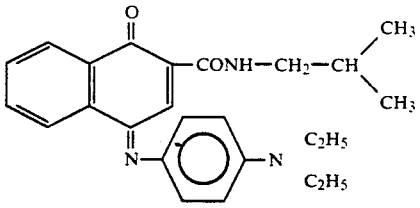
Cyan dye C02
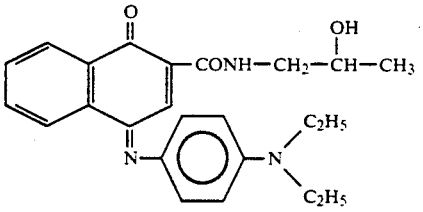
Cyan dye C03
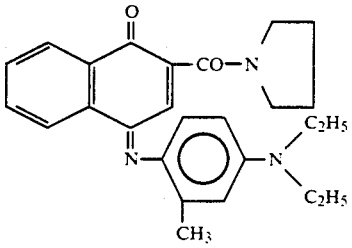
Cyan dye C04
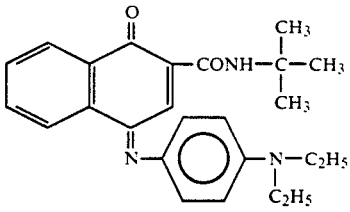
Cyan dye C05
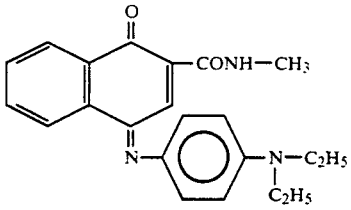
Magenta dye M01
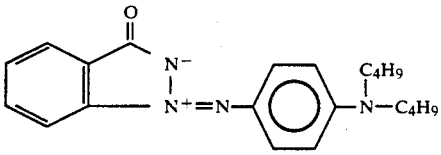
Magenta dye M02
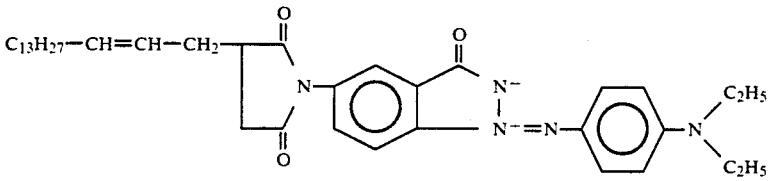

TABLE 2-continued

Magenta dye M03

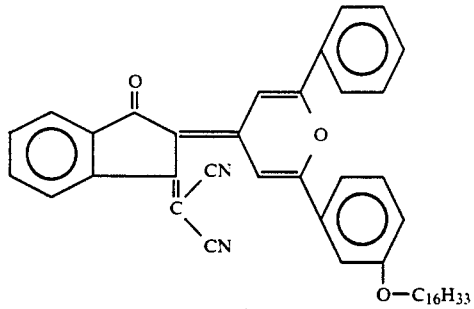

Yellow dye Y01

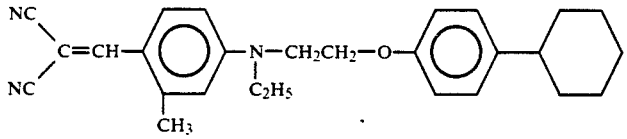

Yellow dye Y02

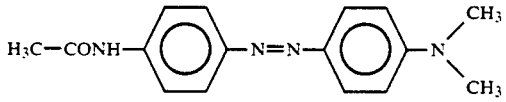

Yellow dye Y03

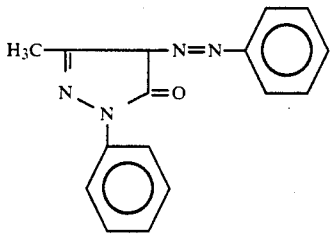

The dye/binder layer comprises from 0.05 to 1 g of the abovementioned dyes per m2.

The binder of the dye/binder layer may be composed only of modified dextran binder according to the present invention or of a mixture of such modified dextran binder with said supplementarily modified dextran binder or of a mixture of at least one known binder with a binder according to the present invention. A list of known binders that can be used in combination with the binder according to the present invention was given hereinbefore.

The dye/binder layer can also comprise other components such as e.g. curing agents, preservatives, and other ingredients, which have been described exhaustively in EP-A 0.133.011. EP-A 0.133.012. and EP-A 0,111,004.

According to a preferred embodiment of the present invention the dye/binder layer comprises at least one releasing agent. Even higher transfer densities are obtained in that case. Suitable releasing agents are i.a. solid waxes. fluorine- or phosphate-containing surfactants, and silicone oils.

Any material can be used as the support for the dye-donor element provided it is dimensionally stable and capable of withstanding the temperatures involved, i.e. up to 400° C. over a period of up to 20 msec, and is yet thin enough to transmit heat supplied to one side through to the dye on the other side to effect transfer to the receiver sheet within such short periods, typically from 1 to 10 msec. Such materials include polyesters such as polyethylene therephthalate, polyamides, polyacrylates, polycarbonates, cellulose esters, fluorinated polymers, polyethers, polyacetals, polyolefins, polyimides, glassine paper, and condenser paper. Preference is given to a support comprising polyethylene terephthalate. In general, the support has a thickness of 2 to 30 μm. If desired, the support can be coated with an adhesive or subbing layer.

A dye barrier layer comprising a hydrophilic polymer can be provided between the support and the dye/binder layer of the dye-donor element to improve the dye transfer densities by preventing wrong-way transfer of dye towards the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethylene imine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP-A 0,227,091 and EP-A 0,228,065. Certain hydrophilic polymers e.g. those described in EP-A 0,227,091 also have an adequate adhesion to the support and the dye/binder layer, thus eliminating the need for a separate adhesive or subbing layer. These particular hydrophilic polymers used in one single layer in the dye-donor element thus perform a dual function, hence are referred to as dye barrier/subbing layers. It is also possible to add an amount of modified dextran binder to the dye barrier layer, especially so when the hydrophobicity of the binder is low as a result of appropriate substitution, at least some of the hydroxy groups of said modified dextran binder having been modified into one or more groups chosen from the class consisting of ether groups, carboxylic ester groups, carbonate groups, carbamoyloxy groups, hemiacetal groups, and acetal groups.

Preferably the reverse side of the dye-donor element can be coated with a slipping layer to prevent the printing head from sticking to the dye-donor element. Such a slipping layer would comprise a lubricating material such as a surface-active agent, a liquid lubricant, a solid lubricant, or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, and fluoroalkyl $C_2$-$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid esters. Suitable slipping layers have been described in e.g. EP-A 0,138,483, EP-A 0,227,090, U.S. Pat. No. 4,567,113, U.S. Pat. No. 4,572,860, and U.S. Pat. No. 4,717,711.

The dye-donor element can be used in sheet form or in the form of a continuous roll or ribbon. If a continuous roll or ribbon is employed, it preferably has sequential repeating areas of different dyes, such as magenta and/or cyan and/or yellow and/or black dyes.

The support of the receiver sheet to be used in combination with the dye-donor element may be a transparant film of e.g. polyethylene terephthalate, a polyether sulfone a polyimide, a cellulose ester, and a polyvinyl alcohol-coacetal. The support may also be a reflecting one such as e.g. baryta-coated paper, polyethylene-coated paper, and white polyester or polyvinyl chloride i.e. white-pigmented polyester or polyvinyl chloride.

To avoid poor adsorption of the transferred dye to the support of the receiver sheet, this support must be coated with a special surface, generally known as dye-image-receiving layer, into which the dye can diffuse more readily. The dye image-receiving layer may comprise polymers such as e.g. polycarbonate, polyurethane, polyester, polyamide, polyvinyl chloride, polystyrene-coacrylonitrile, polycaprolactone, and mixtures thereof.

According to the above-described method of the present invention the dye-image-receiving layer may also comprise a said supplementarily modified dextran.

It is also possible to use a dye-image-receiving layer comprising an above-mentioned known polymer and/or a said supplementarily modified dextran and/or a dextran modified only with hydrophilic or polar groups such as e.g. nitrate, sulphate, sulphonate, phosphate, and carboxylate groups.

Dextran binder modified only with hydrophilic or polar groups such as nitrate, sulphate, sulphonate, phosphate, and carboxylate groups can be prepared as illustrated by the following preparation examples.

Preparation of Dextran Succinate

Esterification of dextran having an average molecular weight of 70,000 is carried out with 500 g of dextran and 1200 g of succinic anhydride dissolved in 8 l of formamide. A solution of 300 g of dimethylaminopyridine in 2 l of formamide is added. The reaction mixture is stirred for 24 h at 40° C. The reaction product is precipitated in a 4-fold volume of diethyl ether, rinsed, and dried.

Preparation of Dextran Sulphate

An amount of 200 g of dextran having an average molecular weight of 70,000 is dissolved in 1 l of formamide and added slowly to a solution of 430 g of chlorosulphonic acid in 1.5 l of pyridine. The reaction is continued for 5 h at 70° C. The reaction mixture is poured out into ethanol, filtered, and dried.

Suitable dye-image-receiving layers have been described in e.g. EP-A 0,133,011, EP-A 0,133,012, EP-A 0,144,247, EP-A 0,227,094, and EP-A 0,228,066. Polyvinyl chloride (PVC) can be used as self-supporting dye-image-receiving element as described in e.g. EP-A 147,747. A self-supporting PVC element containing a dye image obtained by thermal dye transfer can be used in the manufacture of identification documents (ID-cards) by laminating to the element containing the dye image a hydrophobic resin element, preferably a transparent PVC sheet forming a perfect seal protecting the document against forgery.

UV-absorbers and/or antioxidants may be incorporated into the dye-image-receiving layer for improving the fastness to light and other stabilities of the recorded images.

In order to confine the transferred dye to the dye-image-receiving layer a dye-barrier layer can be provided between the support and the said dye-image-receiving layer. This dye-barrier layer can be of the type used in the dye-donor element.

It is generally known to use a releasing agent that aids in separating the receiver sheet from the dye-donor element after transfer. Whereas according to the present invention, however, excellent antisticking properties are realized between the dye-donor element and the contacting receiver sheet, which render the use of a releasing agent in the dye-image-receiving layer of the receiver sheet or in a separate layer on at least part of the dye-image-receiving layer substantially superfluous, it is self-evident that the scope of the present invention also encompasses the use of such releasing agent or of such separate layer comprising a releasing agent in the receiver sheet. Furthermore, the scope also extends to the use of a releasing agent in the dye/binder layer or in a separate layer on the dye/binder layer of the dye-donor element. Solid waxes. fluorine- or phosphate-containing surfactants, and silicone oils can be used as releasing agent. A suitable releasing agent has been described in e.g. EP-A 0,133,012, JP 85/19138, and EP-A 0,227,092.

When the dye transfer is performed for but one single colour, a monochrome dye transfer image is obtained. A multicolour image can be obtained by using a dye-donor element containing three or more primary colour dyes and sequentially performing the process steps described above for each colour. The above sandwich of dye-donor element and receiver sheet is then formed on three or more occasions during the time heat is being supplied by the thermal printing head. After the first dye has been transferred, the elements are peeled apart. A second dye-donor element or another area of the dye-donor element with a different dye area is then brought in register with the receiver sheet and the process is repeated. The third colour and optionally further colours are obtained in the same manner.

In addition to thermal printing heads, infrared flash and heated pins can be used as a heat source for supplying the heat energy. Thermal printing heads that can be used to transfer dye from the dye-donor elements of the present invention to a receiver sheet are commercially available. A scanning laser beam can be used as well as a heat source for supplying the heat energy. The heat generated by the laser beam causes the dyes to volatilize or sublimate and transfer to the dye-image-receiving layer of the receiver sheet. Processes using such scanning laser beam have been described in e.g. GB-A 2,083,726 and in Journal of Applied Photographic Engineering, vol. 3.No. 1, Winter 1977, p. 40–43.

The following example illustrates the present invention.

Example 1

A dye-donor element was prepared as follows.

To avoid sticking of the dye-donor element to the thermal printing head the rear side of a 5 μm polyethylene terephthalate support was provided first with a solution for forming a slipping layer, said solution comprising 10 g of co(styrene/acrylonitrile) comprising 67% styrene units and 33% acrylonitrile units, which copolymer is sold under the trade mark LURAN 378 P by B.A.S.F., 1 g of polysiloxane polyether copolymer sold under the trade mark TEGOGLIDE 410 by T. H. Goldschmidt, and sufficient ethyl methyl ketone solvent to adjust the weight of the solution to a total of 100 g. From this solution a layer having a wet thickness of 15 μm was printed by means of a gravure roll. The resulting layer was dried by evaporation of the solvent.

An amount of 10 mg of dye and 10 mg of binder, both as identified in Table 3 hereinafter were dissolved in 100 ml of ethyl methyl ketone. The resulting ink-like composition was also printed by means of a gravure roll on the front side of the polyethylene terephthalate support in such a way that the resulting dye/binder layer upon drying had a weight of 2.5 g per m2.

A commercially available Hitachi material (VY-SlOOA-paper ink set) was used as receiver sheet.

The dye-donor element was printed in combination with the receiver sheet in a Hitachi colour video printer VY-lOOA.

The receiver sheet was separated from the dye-donor element and the density (Dmax) of the recorded dye image was measured by means of a Macbeth densitometer RD919 in Status A mode through a filter having the colour indicated between parentheses in Table 3. The symbols used for the dyes and the binder in Table 3 refer to the description hereinbefore.

TABLE 3

| Dye | Binder | Dmax |
|---|---|---|
| C01 | D02 | 1.78 (red) |
| M01 | D02 | 2.47 (green) |
| C01 | D03 | 2.46 (red) |
| C01 | D04 | 1.86 (red) |
| C01 | D05 | 2.30 (red) |
| M01 | D05 | 2.48 (green) |
| Y01 | D05 | 2.19 (blue) |
| C01 | D06 | 1.91 (red) |
| C01 | D07 | 1.67 (red) |
| M01 | D07 | 2.29 (green) |
| Y01 | D07 | 2.02 (blue) |
| C01 | D08 | 2.03 (red) |
| M01 | D08 | 2.33 (green) |
| Y01 | D08 | 2.08 (blue) |
| C01 | D11 | 2.19 (red) |

There was no sticking of the dye-donor elements to the receiver sheets and the transferred dye images obtained had a high density.

EXAMPLE 2

A receiver sheet was made as follows.

A polyethylene-coated paper support was coated by means of a doctor knife with a solution of 10% by weight of modified dextran (as identified in Table 4) in ethyl methyl ketone and comprising 1% by weight of the above-mentioned polysiloxane polyether copolymer. The wet thickness of the resulting dye-image-receiving layer was 25 μm.

A commercially available Mitsubishi CPlOO material was used as dye-donor element.

The dye-donor element was printed in combination with the above receiver sheet in a Mitsubishi colour video printer CPlOO.

The receiver sheet was separated from the dye-donor element and the density (Dmax) of the recorded dye image was measured by means of a Macbeth densitometer RD919 in Status A mode. The symbols used for the dyes and the binder in Table 4 refer to the description hereinbefore.

TABLE 4

| Dye | Binder | Dmax |
|---|---|---|
| C01 | D03 | 0.64 |
| M01 | D04 | 0.63 |
| C01 | D05 | 0.63 |
| C01 | D06 | 0.63 |
| C01 | D07 | 0.58 |
| M01 | D08 | 0.54 |

We claim:

1. Dye-donor element for use in thermal dye sublimation transfer methods, said element comprising a support having thereon a dye/binder layer comprising a dye carried by at least one dextran binder, wherein at least some of the hydroxy groups of said binder have been modified into one or more groups chosen from the class consisting of ether groups, carboxylic ester groups, carbonate groups, carbamoyloxy groups, hemiacetal groups, and acetal groups.

2. A dye-donor element according to claim 1, wherein at least some of the hydroxy groups of said dextran binder have been modified into one of the following groups:

$$-O-R^1$$

$$-O-CO-R^2$$

wherein:

$R_1$ represents an alkyl group, a cycloalkyl group, an alkenyl group, or an aryl group, $R_2$ is an alkyl group, a cycloalkyl group, an alkenyl group, an aryl group, or stands for one of the following groups $-OR^3$ and $-N(R_4)R_5$, wherein $R_3$ is an alkyl group, a cycloalkyl group, an alkenyl group, or an aryl group, and each of $R_4$ and $R_5$ (same or different) represent hydrogen or an organic group.

3. A dye-donor element according to claim 1, wherein said dextran has been modified by reaction of hydroxy groups thereof with one or more reagents chosen from haloformates, acid halides, carboxylic acids, alkylating agents, epoxides, aldehydes, chlorosulphonic acid esters, chlorosulphonic acid, and (poly)-phosphoric acid.

4. A dye-donor element according to claim 1, wherein, in case only part of the hydroxy groups of said dextran binder have been modified into one or more groups chosen from the class consisting of ether, carboxylic ester, carbonate, carbamoyloxy, hemiacetal, and acetal groups, at least part of the remaining hydroxy groups have been modified supplementarily into groups that are more hydrophilic or more polar than said ether, carboxylic ester, carbonate, carbamoyloxy, hemiacetal, and acetal groups.

5. A dye-donor element according to claim 4, wherein said more hydrophilic or more polar groups are nitrate, sulphate, sulphonate, phosphate, or carboxylate groups.

6. A dye-donor element according to claim 1, wherein the reverse side of said dye-donor element has been covered with a slipping layer comprising a lubricating material.

7. A dye-donor element according to claim 1, wherein a dye barrier layer is provided between the support and the dye/binder layer.

8. A dye-donor element according to claim 7, wherein said dye barrier layer comprises a dextran binder, at least some of the hydroxy groups of said dextran binder having been modified into one or more groups chosen from the class consisting of ether groups, carboxylic ester groups, carbonate groups, carbamoyloxy groups, hemiacetal groups, and acetal groups.

9. A dye-donor element according to claim 1, wherein said support comprises polyethylene terephthalate.

10. A dye-donor element according to claim 1, wherein it has sequential repeating areas of different dyes.

11. Method of image-wise heating a dye-donor element comprising a support and a dye layer comprising printing dyes carried by a polymeric binder medium, which at least partially is a dextran binder, at least some of the hydroxy groups of which have been modified into ether, carboxylic ester, carbonate, carbamoyloxy, hemiacetal, or acetal groups and, in case only part of the hydroxy groups of said dextran binder have been modified in such groups, at least part of the remaining hydroxy groups have been modified into groups that are more hydrophilic or more polar than said ether, carboxylic ester, carbonate, carbamoyloxy, hemiacetal, and acetal groups and transferring said image-wise heated printing dyes to a dye-image-receiving layer of a receiving sheet, wherein said dye-image-receiving layer comprises a dextran binder, part of the hydroxy groups of which have been modified into ether, carboxylic ester, carbonate, carbamoyloxy, hemiacetal, or acetal groups and the other part of the hydroxy groups have been modified into groups that are more hydrophilic or more polar than said ether, carboxylic ester, carbonate, carbamoyloxy, hemiacetal, or acetal groups.

* * * * *